US012521588B2

(12) United States Patent
Popescu

(10) Patent No.: US 12,521,588 B2
(45) Date of Patent: Jan. 13, 2026

(54) EXERCISE APPARATUS USING BIDIRECTIONAL ADAPTIVE RESISTANCE

(71) Applicant: Marius Popescu, Livermore, CA (US)

(72) Inventor: Marius Popescu, Livermore, CA (US)

( * ) Notice: Subject to any disclaimer, the term of this patent is extended or adjusted under 35 U.S.C. 154(b) by 138 days.

(21) Appl. No.: 18/640,852

(22) Filed: Apr. 19, 2024

(65) Prior Publication Data

US 2024/0299796 A1 Sep. 12, 2024

(51) Int. Cl.
*A63B 21/00* (2006.01)
*A63B 21/018* (2006.01)
*A63B 21/22* (2006.01)

(52) U.S. Cl.
CPC .. *A63B 21/00192* (2013.01); *A63B 21/00072* (2013.01); *A63B 21/018* (2013.01); *A63B 21/154* (2013.01); *A63B 21/22* (2013.01); *A63B 21/4035* (2015.10)

(58) Field of Classification Search
CPC ..... A63B 21/00192; A63B 21/00072; A63B 21/018; A63B 21/154; A63B 21/22; A63B 21/4035; A63B 21/00069; A63B 21/0056; A63B 21/0058; A63B 21/0628; A63B 2209/08; A63B 21/4045; A63B 22/205; A63B 71/0054; A63B 21/0051; A63B 2071/0081
See application file for complete search history.

(56) References Cited

U.S. PATENT DOCUMENTS 3,447,006 A 5/1969 Blair
4,224,545 A 9/1980 Powell
4,544,111 A 10/1985 Nakajima
5,712,520 A 1/1998 Lamb
6,042,517 A 3/2000 Gunther et al.
8,490,751 B2 7/2013 Allington et al.
9,393,475 B2 7/2016 Colan
9,415,693 B2 8/2016 Marzano et al.
10,004,933 B2 6/2018 Lennox et al.
10,110,089 B2 10/2018 Deihl et al.
10,471,297 B1 * 11/2019 Smith ..... A63B 24/0087
10,537,764 B2 1/2020 Smith et al.
10,751,573 B2 8/2020 Lu
10,953,266 B2 * 3/2021 Leopoldo da Camara Filho ..... A63B 21/00
11,642,564 B2 5/2023 Watterson
2012/0053014 A1 * 3/2012 Zhu ..... A63B 21/4035 482/5
2018/0169463 A1 * 6/2018 Ellis ..... A63B 23/03575
2018/0272182 A1 * 9/2018 Hou ..... A63B 22/0076
(Continued)

*Primary Examiner* — Andrew S Lo

(74) *Attorney, Agent, or Firm* — Steven A. Nielsen; www.NielsenPatents.com

(57) ABSTRACT

Disclosed exercise machines provide adaptive resistance in both directions of cable or flexible member movement. Perceived or felt resistance increases in response to the effort and/or speed of movement exerted by a user. During exercise, a user may become fatigued making further movement or weight support unwanted. With the disclosed embodiments, a user may simply stop their effort and the resistance and movement of the machine will stop. There are no plates or physical weights to harm a user and operation of the machine occurs in near silence. The disclosed embodiments are well suited for both beginner and accomplished athletes as the resistance adjusts seamlessly and continuously to match the force exerted by the user.

6 Claims, 9 Drawing Sheets

(56) References Cited

U.S. PATENT DOCUMENTS

| | | | | |
|---|---|---|---|---|
| 2019/0118021 | A1* | 4/2019 | Liu | A63B 21/0084 |
| 2019/0344123 | A1* | 11/2019 | Rubin | A63B 21/153 |
| 2019/0366148 | A1* | 12/2019 | Hsu | A63B 1/00 |
| 2023/0304548 | A1 | 9/2023 | Wrobel | |

* cited by examiner

EXERCISE APPARATUS USING BIDIRECTIONAL ADAPTIVE RESISTANCE

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to adaptive resistance exercise machines. More particularly, the invention relates to exercise machines with bidirectional and adaptive resistance that can be proportional to the effort exerted by the user while providing adjustment to resistance parameters.

(2) Description of the Related Art

U.S. Pat. No. 4,224,545 by Powell presents an eddy brake system with a magnetic circuit coupled to a rotor. The systems of Powell are not well suited for exercise machines do their mechanical complexity and use of numerous moving parts. U.S. Pat. No. 4,544,111 by Nakajima, U.S. Pat. No. 5,712,520 by Lamb, U.S. Pat. No. 6,042,517 by Gunther et al, U.S. Pat. No. 5,712,520 by Lamb, U.S. Pat. No. 8,490,751 by Allington also present various magnetic control systems but are unduly bulky with numerous parts, having a footprint that is too large for commercial adaptation for a piece of gym equipment.

BRIEF SUMMARY OF THE INVENTION

The present invention overcomes shortfalls in the related art by presenting an unobvious and unique combination, configuration and use of flexible members, pulleys, cables, drums, and various means of resistance to provide an exercise machine that is devoid of weights or plates and that provides adaptive and seamless perceived resistance in response to the effort exerted by a user.

In the related art, exercise machines often comprise physical weights, sometimes taking the form of plates that are retained by use of guide rails and are sometimes selected by use of a center pin. Plates or other physical weights used in exercise or by an exercise machine present a myriad of problems and dangers. A user's fingers can be damaged by the movement of plates and the use of physical weights adds to the footprint of the machine. Moreover, in mid use, a user may become fatigued but still must lower or content with a weight that is no longer manageable which sometimes causes injury to the user. Thus, what is needed is an exercise machine that stops pressing down upon a user when the user stops pressing. Such a system is not available with the traditional physical weight systems of the prior art.

The disclosed embodiments overcome the shortfalls in the related art by presenting a new machine that has a relatively small footprint by use of, inter alia, systems of adaptive load technology which constantly self-adjust to comport with the effort applied by the user. Unlike the related art which uses fixed resistance via noisy and bulky weights, the disclosed embodiments allow a user to stop the machine in mid motion in response to the user simply stopping effort. Thus, a user who is fatigued in mid motion does not risk injury by a weight or handle dropping downwardly.

The disclosed embodiments also overcome shortfalls in the related art by presenting a new exercise machine that provides both positive and negative resistance which is sometimes known as or referred to as push and pull resistance. Thus, a user may experience resistance in both an upper movement and downward movement while engaged in the same exercise. This provides an efficiency in exercise not available in the prior art.

Disclosed embodiments are efficient in construction, maintenance, ease of use and physical size or footprint. In one disclosed embodiment a single flexible member may be in a looped form and may be retained and or controlled by a drum. The flexible member may be looped several times around the drum, with the drum securing the flexible member via frictional attachment. Thus, as the drum is controlled by the surrounding systems, the flexible member may be instantaneously controlled with such control including stopping, a change in direction and variable resistance with such resistance dictated by the movement or effort exerted by the use. A user may access the flexible member by direct contact, a handle attached to the flexible member or by a myriad of other systems including a disclosed carriage system.

The term "flexible member" means and includes: cable, a chain and sprocket system, a belt and gear system, a V belt and sheave system or any other system or component having the requisite strength and flexibility to comport to a disclosed embodiment.

The term "drum" means and includes: an object having means of rotation or an object having an axis of rotation.

Disclosed embodiments may include the use of a disk or conductor disk attached to a drum. The movement and/or adaptive resistance of the conductor disk may be influenced by the movement of the drum and/or a resistance or absence of resistance applied to the conductor disk, with such resistance or absence of resistance applied by various means such as a magnetic system, electrical eddy currents, an electric motor, one or more magnets, frictional resistance viscous systems, wind resistance and other systems. A conductor disk may comprise or be made of material such as metal that may be influenced by a magnetic field.

Disclosed embodiments may include on or more magnets or other means of electrical current or eddy current that are near to or in electrical connection or magnetic connection to the conductor disk. Such a component, such as a magnet, may be supported near the conductor disk by means of adjustable positioning between the magnet and conductor disk. Alternatively, a conductor disc could be secured by adjustable means with respect to a fixed magnetic system.

Disclosed embodiments include the use of magnets, means of eddy currents, means of frictional resistance, viscous systems, wind resistance and electric motors.

Other disclosed embodiments are described and illustrated herein.

REFERENCE NUMERALS IN THE DRAWINGS

Figure 2:
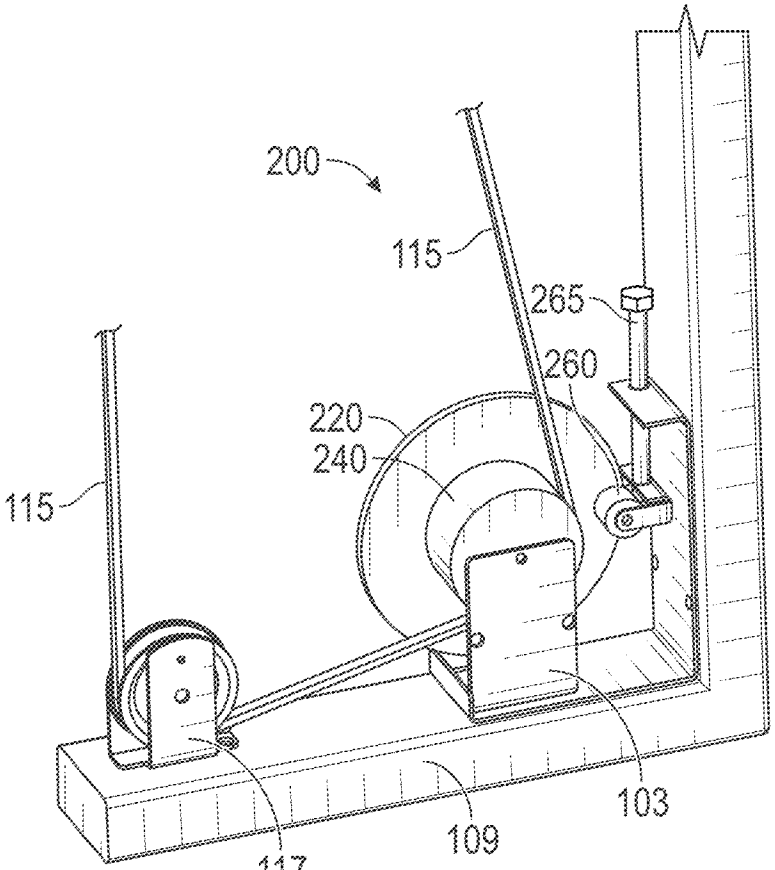
FIG. 2 is a perspective view of disclosed components

100 disclosed exercise machine
103 bottom bracket
109 bottom of frame
110 main frame
111 top frame member
112 top pulley
115 flexible member
116 flexible member loop
117 bottom pulley
118 counter weights attached to flexible member 115
120 fastener
122 handle
200 resistance system
220 conductor disk or disk
222 disk sprocket
240 drum
260 magnet
261 magnet bar
262 magnet assembly
265 adjustment rod for magnet
266 resistance adjustment arm
270 sprocket
272 sprocket chain
300 carriage system
301 carriage cover
303 carriage frame
305 carriage rail
307 carriage wheels
310 carriage swing arm
311 universal joint
315 carriage handle
330 carriage assembly
400 lower bracket
410 lower axle
450 upper bracket
460 upper axle
480 vertical support bracket These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Figure 1:
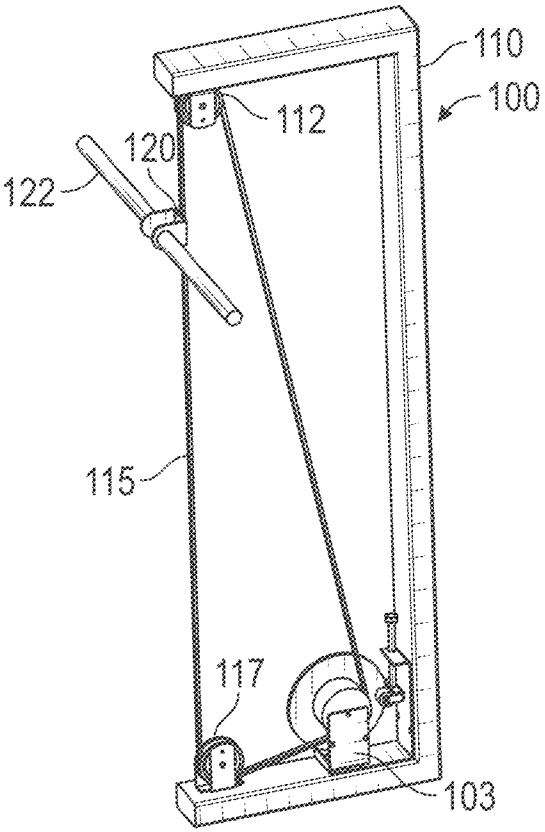
FIG. 1 is a perspective view of a disclosed embodiment

FIG. 1 illustrates an embodiment 100 comprising a main frame 110 supporting and in attachment to a bottom pulley 117, a top pulley 112, a drum 240 and conductor disk 220. In one embodiment, a flexible member runs through the top pulley, bottom pulley and around the drum. Movement of the flexible member may cause the drum to rotate. The drum may in fixed, frictional or other mechanical attachment to the conductor disk. The conductor disk may be in communication with a magnetic system, magnet, electro magnet or any other eddy current device or other means of resistance. This base configuration exhibits all of the advantages over the prior art as discussed above and provides adaptive resistance, push pull resistance and user safety in response to the movement or nonmovement of the flexible member as discussed above.

A user may pull the flexible member in an upward or downward direction by grabbing the flexible member directly or by use of any type of handle 112. A handle may be attached directly to the flexible member or may attach by use of a fastener 120 connecting to the flexible member to the handle.

The disclosed embodiment of FIG. 1 presents an advantage over the prior art via mechanical advantages in having the drum and conductor disk in fixed, direct and parallel attachment. With both components spinning on the same axis of rotation there are efficiencies in movement and greater reliability with the absence of linkage components. However, the principles of operation and advantages of the machine as described herein are applicable to embodiments wherein the drum and conductor disk are separated but yet mechanically connected.

Means of adjusting the distance of a magnet from the conductor disk are optional but may include an adjustment rod 265 wherein the distance between the conductor disk and magnetic field may be adjusted.

FIG. 2 depicts an enlarged view of the drum and conductor disk area of FIG. 1.

Figure 3:
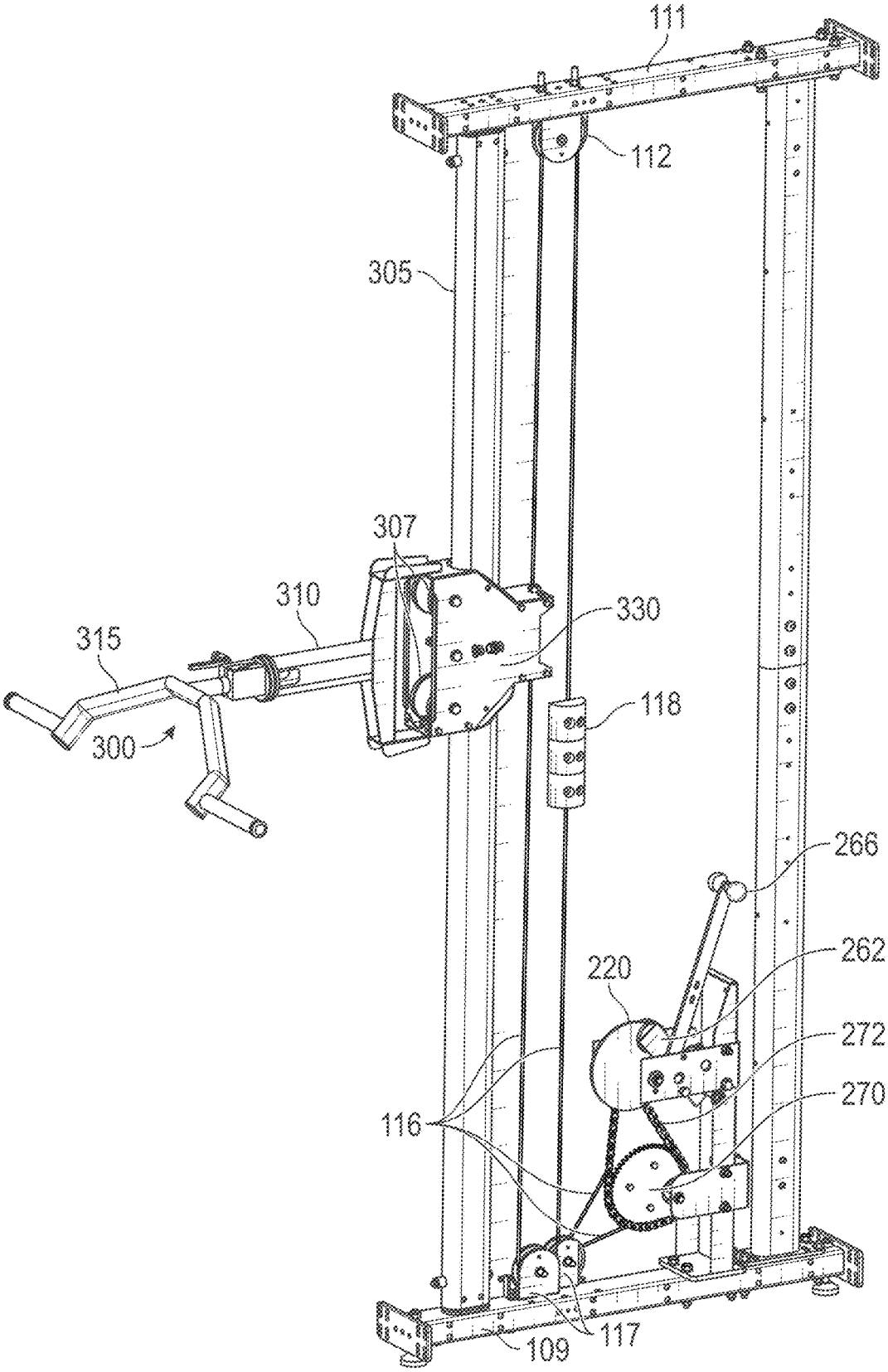
FIG. 3 is a perspective view of a disclosed embodiment

Referring to FIG. 3, a modified version of the embodiment of FIG. 1 is presented wherein the flexible member 115 loops back from the drum and to the base 109 of the frame by use of a second bottom pulley 117. The flexible member then proceeds to the top pulley 112. This configuration provides a mechanical advantage in separating the drum from the conductor disk providing a different gear ratio between the drum and conductor disk and providing room for a more intricate magnet adjustment system.

A sprocket 270 may be attached to the drum and the sprocket may be in rotational or chained attachment to the conductor disk 220.

Figure 4:
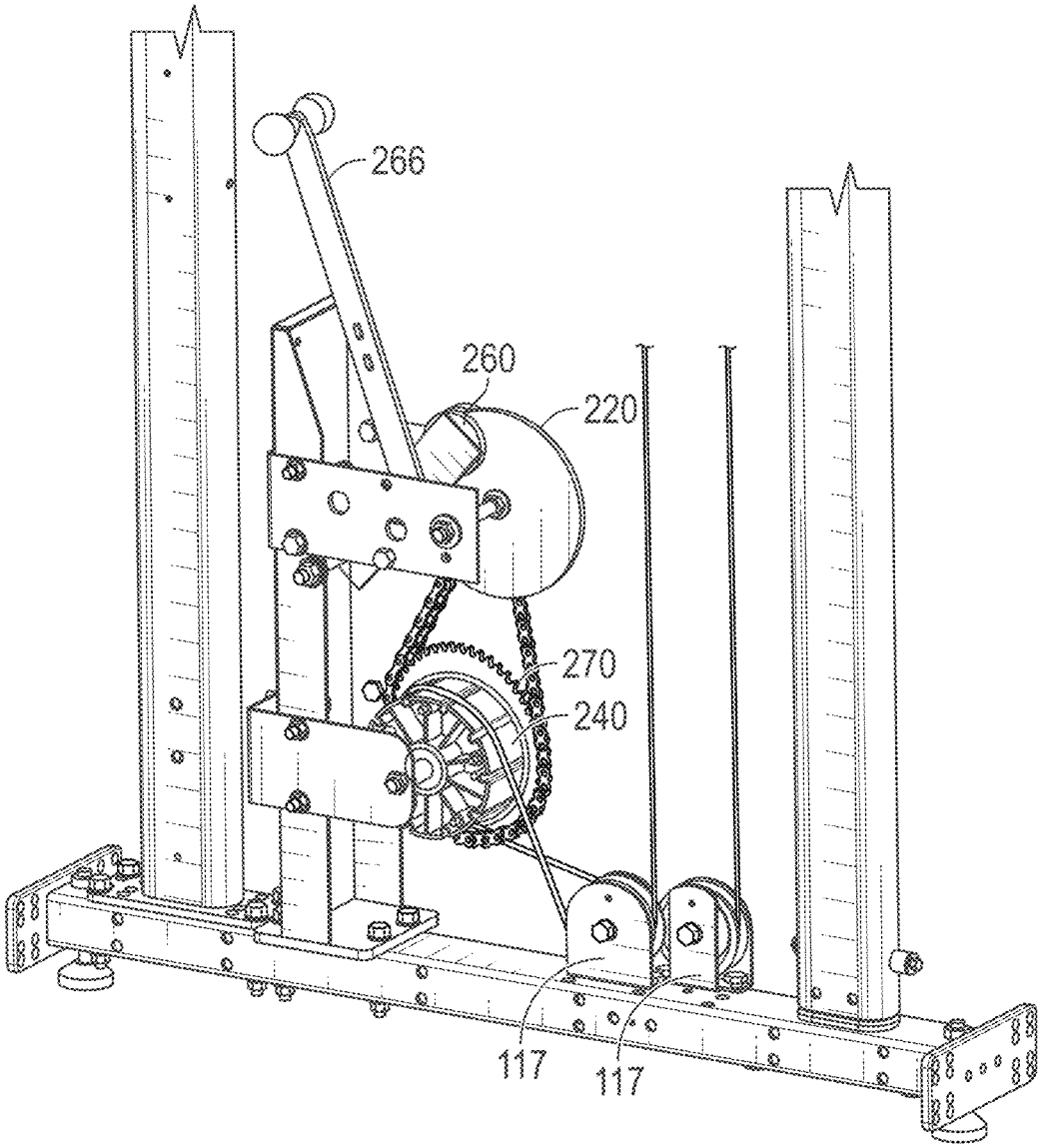
FIG. 4 is a perspective view of disclosed components

FIG. 4 shows an expanded view of the drum and conductor disk system of FIG. 3.

Figure 5:
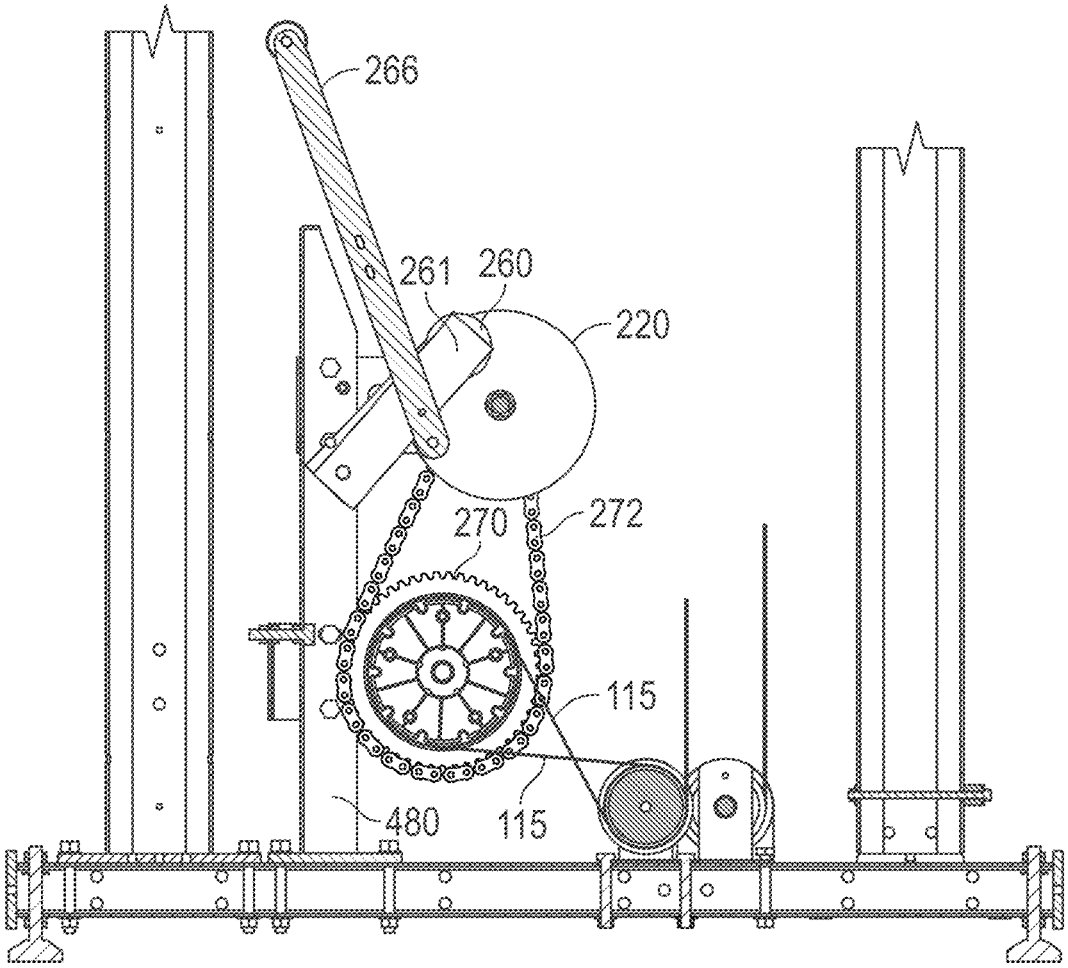
FIG. 5 is a sectional view of disclosed components

FIG. 5 shows a sectional view of FIG. 4. A magnet bar 261 may be used to hold a magnet 260 and a magnet bar may be in pivotal attachment to a vertical support bracket 480 and attached to a resistance adjustment arm 266.

Figure 6:
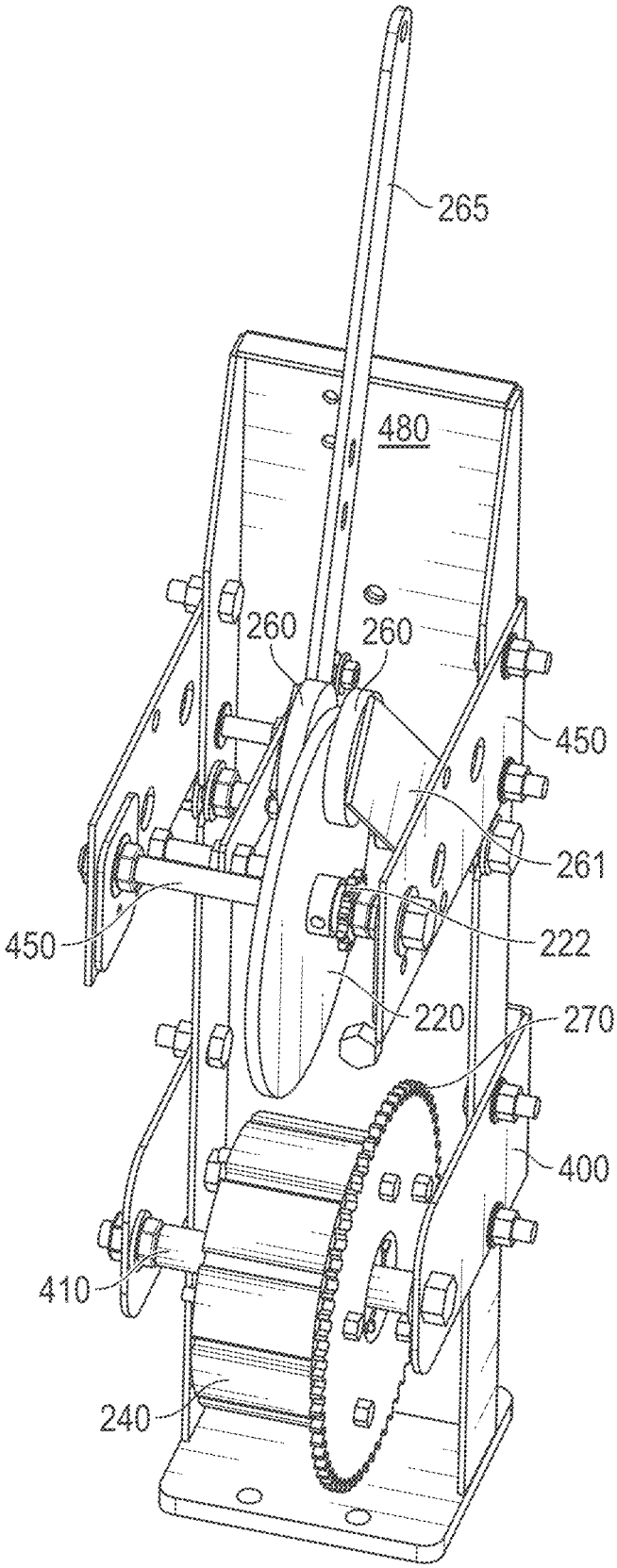
FIG. 6 is a perspective view of disclosed components

FIG. 6 presents a front and side perspective view of a conductor disk and drum configuration. The drum may rotate upon a lower axle 410 and the conductor disk may rotate around an upper axle.

Figure 7:
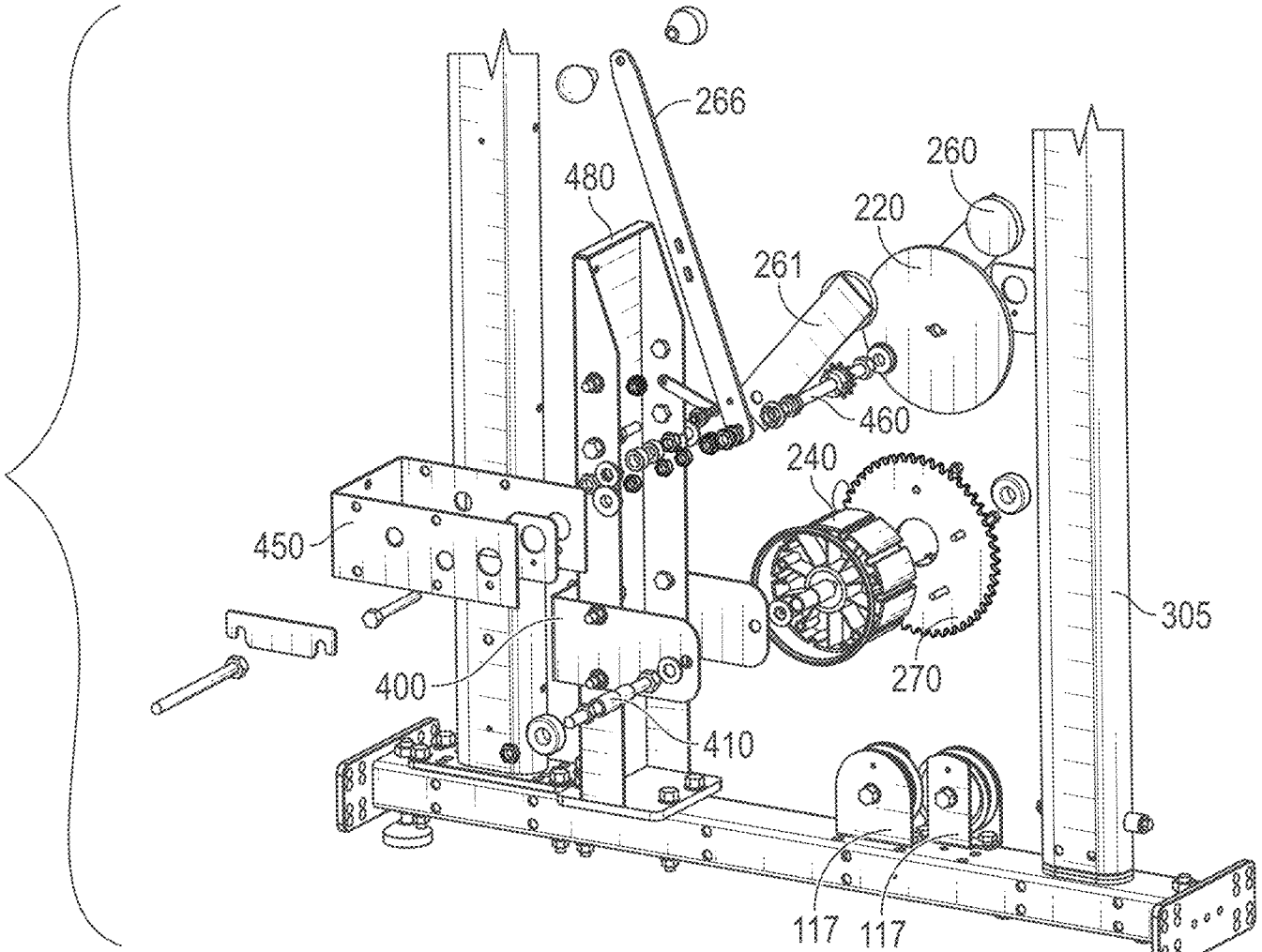
FIG. 7 is an exploded view of disclosed components

FIG. 7 presents an exploded view of FIG. 6.

Figure 8:
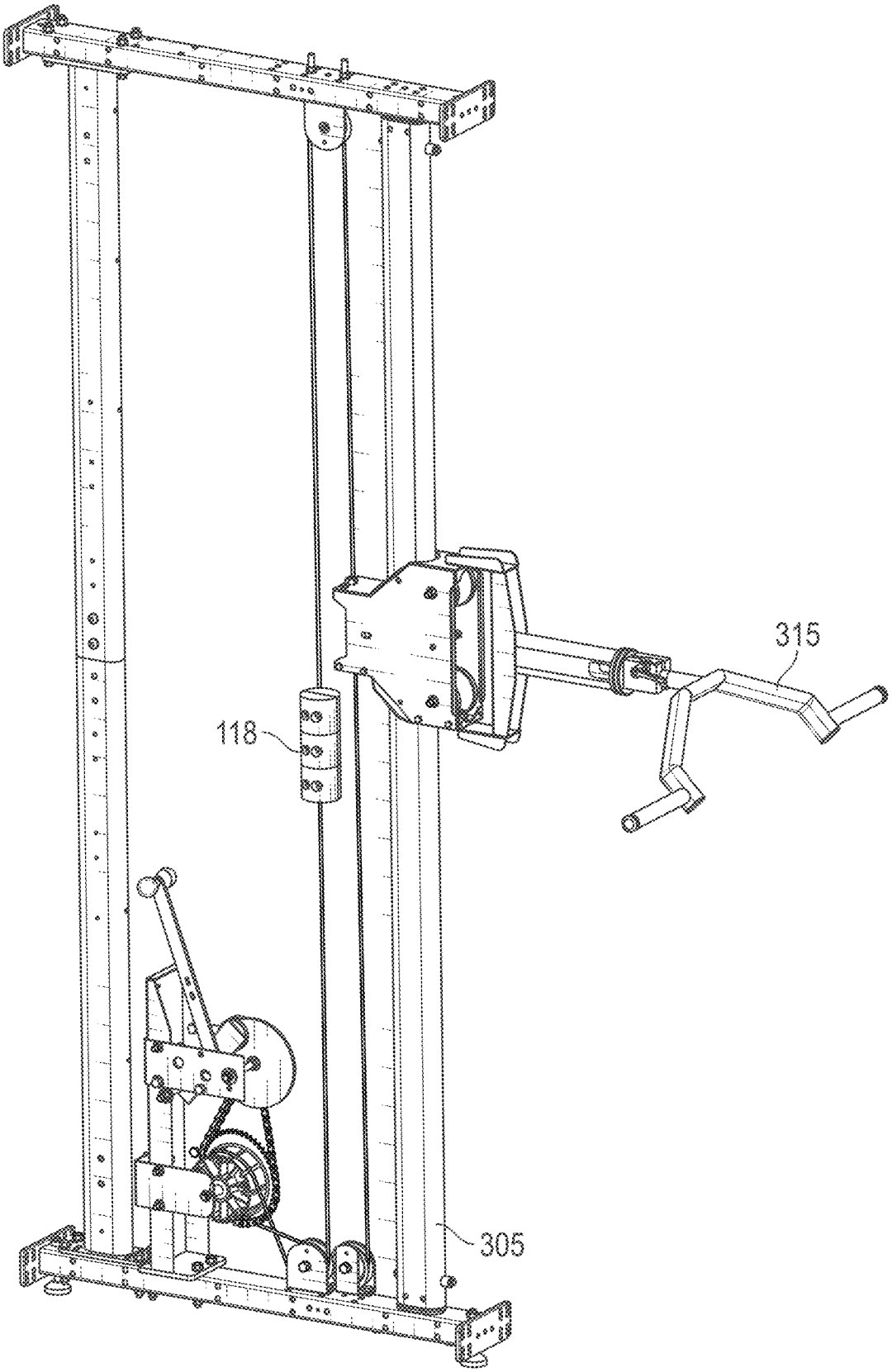
FIG. 8 is a perspective view of a disclosed embodiment

FIG. 8 presents a perspective view of a disclosed embodiment having a carriage handle rotated to a horizontal position.

Figure 9:
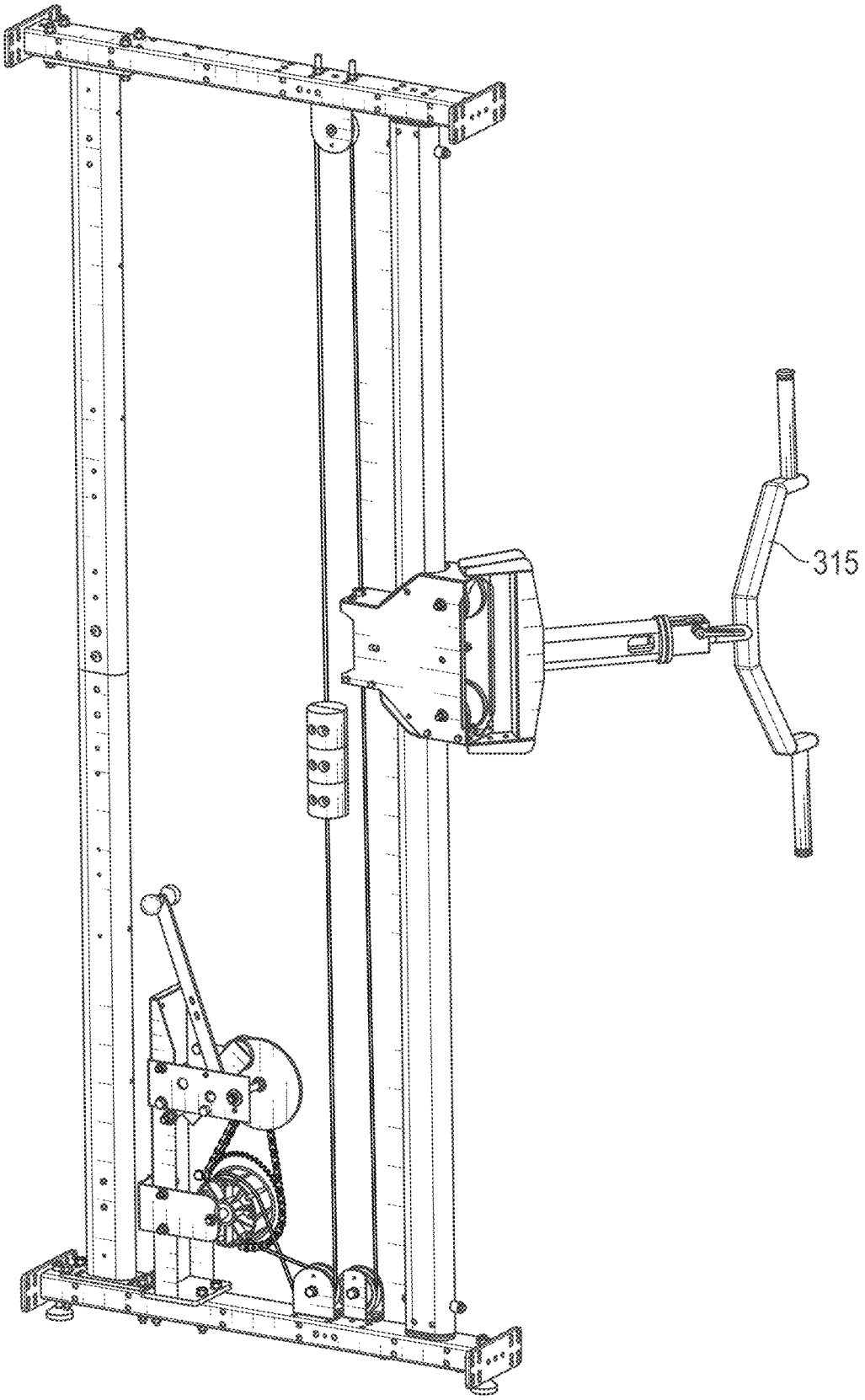
FIG. 9 is a perspective view of a disclosed embodiment

FIG. 9 presents a perspective view of a disclosed embodiment having a carriage rotated to the left and the carriage handle rotated to a vertical position.

Figure 10:
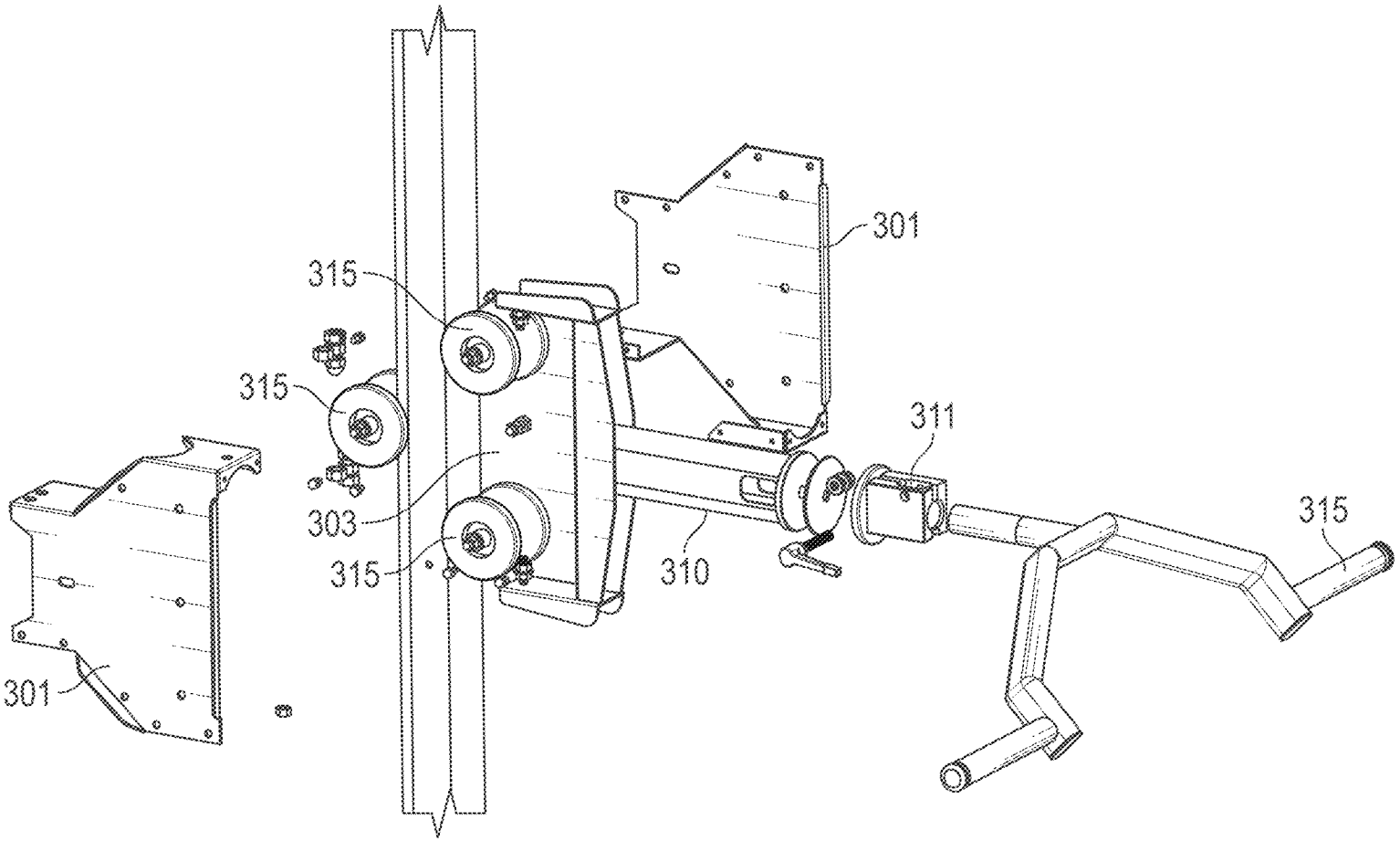
FIG. 10 is an exploded view of disclosed components

FIG. 10 presents an exploded view of carriage components.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. An adaptive resistance exercise machine, the machine comprising:

a) a flexible member in frictional attachment to a drum, wherein movement of the flexible member exerts rotational force upon the drum;

b) the drum in rotational connection to a conductor disk, such that rotational force exerted upon the drum is transmitted to rotational force upon the conductor disk;

c) the conductor disk disposed in proximity to a magnetic field, such that the magnetic field may be moved into position to create resistance to the rotation of the conductor disk in response to rotation of the drum, with the rotation of the drum caused by movement of the flexible member; and d) the flexible member moves within a first and second bottom pulley with each bottom pulley attached to a lower frame member and the flexible member further moves within a top pulley, the top pulley secured to a top frame member.

2. The adaptive resistance exercise machine of claim 1 wherein the magnetic field is created by one or more magnets.

3. The adaptive resistance exercise machine of claim 2 wherein the one or more magnets are attached to a resistance adjustment arm.

4. The adaptive resistance exercise machine of claim 1 wherein an exercise handle and/or a carriage system is attached to the flexible member.

5. The adaptive resistance exercise machine of claim 1 wherein adaptive resistance is achieved by use of a viscus damper or an electromagnetic system or a friction pad or an electric motor or eddy currents.

6. An adaptive resistance exercise machine, the machine comprising:

a) a flexible member in frictional attachment to a drum, wherein movement of the flexible member exerts rotational force upon the drum;

b) the drum in rotational connection to a conductor disk, such that rotational force exerted upon the drum is transmitted to rotational force upon the conductor disk;

c) the conductor disk disposed in proximity to a magnetic field, such that the magnetic field may be moved into position to create resistance to the rotation of the conductor disk in response to rotation of the drum, with the rotation of the drum caused by movement of the flexible member; and d) counter weights attached to the flexible member.

* * * * *